United States Patent [19]

Winston

[11] 4,214,657

[45] Jul. 29, 1980

[54] TOOTHBRUSH HOLDER AND STERILIZER

[76] Inventor: Billy G. Winston, 1900 E. 4th St., Fort Worth, Tex. 76102

[21] Appl. No.: 951,193

[22] Filed: Oct. 13, 1978

[51] Int. Cl.[2] ..... B65D 81/24; A47K 1/09

[52] U.S. Cl. ..... 206/209.1; 206/362.1

[58] Field of Search ..... 206/209, 209.1, 210, 206/362, 362.1, 362.2, 370; 211/65-66; 248/110; 312/31, 31.2, 206; 422/300

[56] References Cited

U.S. PATENT DOCUMENTS

| | | | |
|---|---|---|---|
| 827,308 | 7/1906 | Hitch | 206/209.1 |
| 1,595,528 | 8/1926 | Seligson | 206/209.1 |
| 2,012,685 | 8/1935 | LaPosea | 206/209.1 |
| 2,508,773 | 5/1950 | Reichmuth | 206/209.1 |
| 3,207,296 | 9/1965 | Goodall | 206/209.1 |
| 3,881,868 | 5/1975 | Duke | 206/209.1 |
| 3,884,635 | 5/1975 | Sloan | 206/209.1 |

FOREIGN PATENT DOCUMENTS

| | | | |
|---|---|---|---|
| 299137 | 10/1928 | United Kingdom | 206/209 |

*Primary Examiner*—Herbert F. Ross
*Attorney, Agent, or Firm*—Wofford, Fails & Zobal

[57] ABSTRACT

A receptacle having an open ended cavity for receiving a toothbrush and a sponge carrying a sterilizing fluid for sterilizing the toothbrush. Two removable caps are provided for closing opposite ends of the receptacle. The toothbrush when located in the cavity of the receptacle has a portion extending beyond one end of the receptacle. The cap employed for closing this end of the receptacle has a cavity for receiving the extending end of the toothbrush.

2 Claims, 4 Drawing Figures

TOOTHBRUSH HOLDER AND STERILIZER

SUMMARY OF THE INVENTION

It is an object of the present invention to provide a novel and easy to use toothbrush holder and sterilizer.

It is a further object of the present invention to provide a toothbrush holder and sterilizer which is convenient to carry and easy to clean and service.

The toothbrush holder and sterilizer comprises receptacle means having an open ended cavity for receiving a toothbrush and absorbent means carrying a sterilizing fluid. Two removable caps means are provided for closing opposite ends of said receptacle means. The toothbrush when located in said cavity of said receptacle means adjacent said absorbent means has a portion extending beyond the end of said receptacle means. One of said cap means has a cavity with length sufficient to receive the extending portion of the toothbrush.

DESCRIPTION OF THE PREFERRED EMBODIMENT

Figure 1:
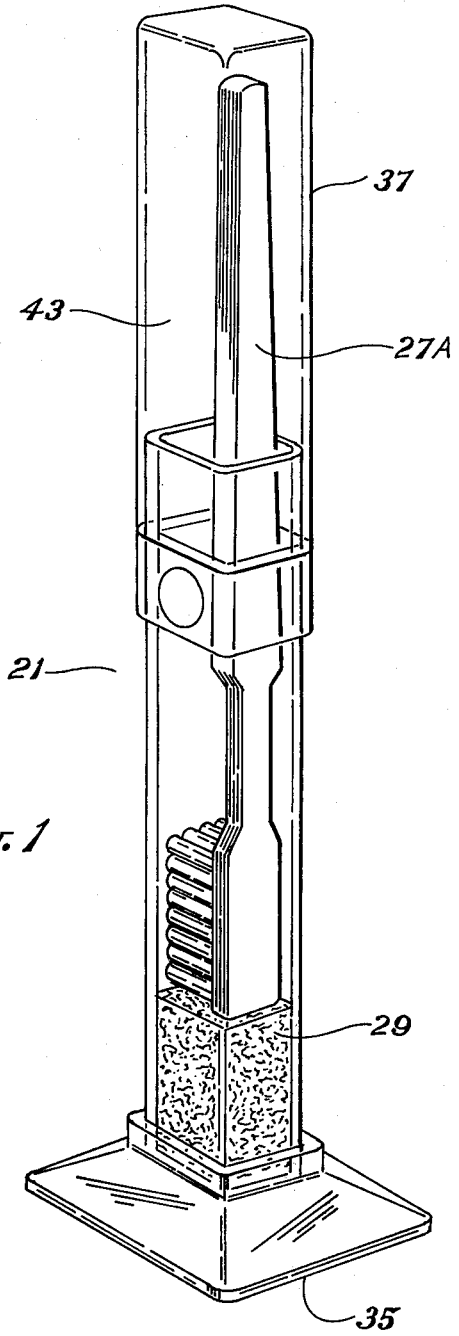
FIG. 1 illustrates one embodiment of the toothbrush holder and sterilizer of the present invention.
Figure 2:
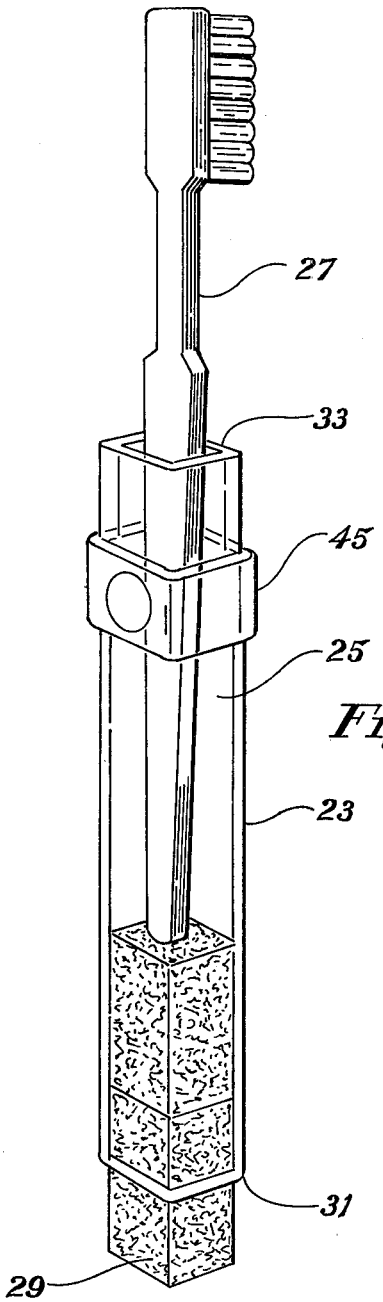
FIG. 2 illustrates the manner in which a used sponge may be removed and a fresh sponge carrying a sterilizing fluid may be inserted into the cavity of the receptacle of the holder of FIG. 1.
Figure 3:
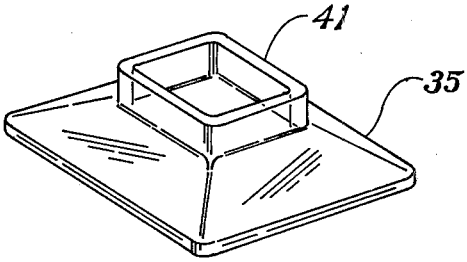
FIG. 3 illustrates the bottom cap of the toothbrush holder of FIG. 1.

Referring now to FIGS. 1–3, the toothbrush holder and sterilizer of one embodiment of the present invention is identified at 21. It comprises a receptacle 23 having walls forming and elongated cavity 25, rectangular in cross-section, for receiving a toothbrush 27 and a sponge 29 carrying a sterilizing fluid. The sponge 29 is rectangular in cross-section and is adapted to be received in the cavity 25 with a relatively tight fit. The opposite ends 31 and 33 of the receptacle 23 are open and are adapted to be closed by two removable end caps 35 and 37. Cap 35 has surrounding walls 41 which receive the end 31 of the receptacle 23 with a friction fit for closing the receptacle end 31. Cap 35 also serves as a stand for supporting the holder in a vertical position. Cap 37 has walls defining an elongated cavity 43, rectangular in cross-section, for receiving end 33 of the receptacle 23 with a friction fit for closing the receptacle end 33. A band 45 formed around the receptacle 23 limits the position to which the cap 37 may be loacted in its closed position. In use, the sponge 29 is located next to the cap 35 with the bristle end of the toothbrush resting against the sponge. The receptacle 23 has a length such that when the toothbrush is located in its cavity 25 against the sponge 29, the handle 27A of the toothbrush extends beyond the end 31 of the receptacle 23 into the cavity 43 of the cap 37. With the sponge 29 and the toothbrush 27 located in the cavity 25 of the receptacle 23 and with its ends 31 and 33 closed with caps 35 and 37, vapors from the sterilizing fluid carried in the sponge will act to sterilize the toothbrush. When it is desired to use the toothbrush, the cap 37 is removed and the toothbrush grasped by its handle and removed.

If it is desired to remove the old sponge and insert a fresh sponge carrying sterilizing fluid, the caps 35 and 37 are removed. A fresh sponge is inserted into the cavity 25 through the end 31 of the receptacle and pushed down into the cavity 25 by the handle of the toothbrush. When the new sponge reaches the old sponge, it pushes the old sponge out through the end 31. The new sponge then assumes the position shown in FIG. 1. The cavity 25 of the receptacle 23 may be cleaned by completely removing the sponge and running water through the cavity of the receptacle.

The sterilizing fluid employed is a liquid disinfectant which is absorbed into the sponge. In one embodiment, the sterilizing fluid may be diluted phenol. Preferably, the amount of sterilizing fluid absorbed into the sponge is sufficient to wet or dampen the sponge but does not run freely from the sponge. The use of the sponge to carry the sterilizing fluid has advantages in that it eliminates spillage problems which would occur if a free liquid were used. This feature also allows the holder to be safely carried in a suitcase without the problem of spillage of the sterilizing fluid.

Figure 4:
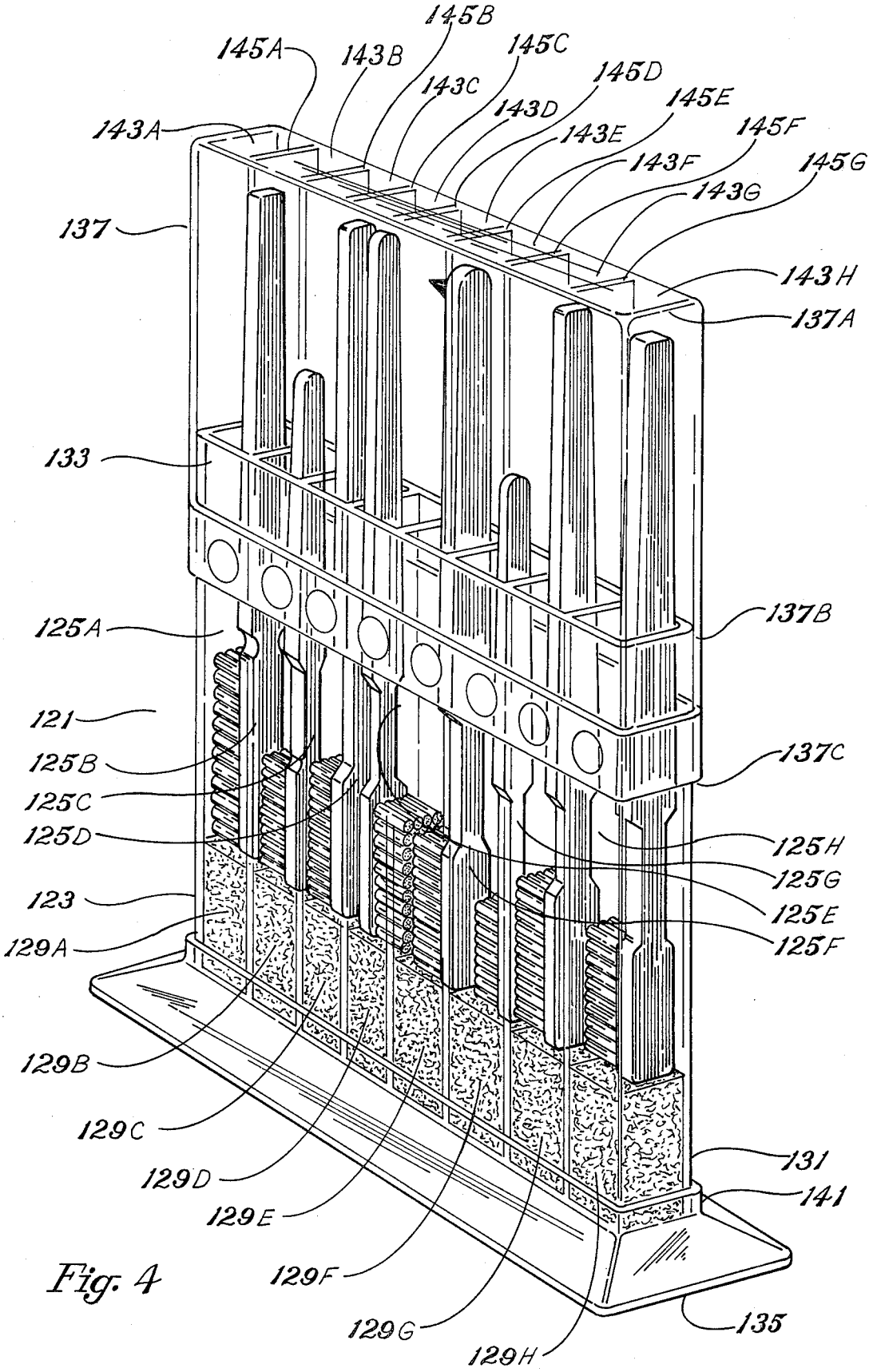
FIG. 4 illustrates another embodiment of the toothbrush holder and sterilizer of the present invention.

Referring now to FIG. 4, the toothbrush holder and sterilizer of this embodiment employs the same principles and features of that of the embodiment of FIGS. 1–3 but is constructed to hold a plurality of toothbrushes. It is identified at 121 and comprises a receptacle 123 having walls defining a plurality of side-by-side cavities 125A–125H, each being rectangular in cross-section, for receiving a plurality of toothbrushes and a plurality of sponges 129A–129H, each carrying a sterilizing fluid. The sponges are rectangular in cross-section and are adapted to be received in the cavities with a relatively tight fit. The opposite ends 131 and 133 of the receptacle are open and are adapted to be closed by two removable end caps 135 and 137. Cap 135 has surrounding walls 141 which receive the end 131 of the receptacle 123 with a friction fit for closing the receptacle end 131. Cap 135 also serves as a stand for supporting the holder in a vertical position. The receptacle 123 has a length such that when the tootbrushes are located in its cavities 125A–125H against the sponges 129A–129H, their handles extend beyond the end 133 of the receptacle 123. Cap 137 has walls defining a plurality of side-by-side elongated cavities 143A–143H for receiving the handles of the toothbrushes when the cap is fitted in its closed position. Inner walls 145A–145G which define the cavities 143A–143H extend from the top end 137A of the cap 137 downward and terminate at a level 137B which is above the lower end 137C of the cap 137. Thus the lower outer wall of the cap 123 may be inserted around the upper surrounding wall of the receptacle 123 with a tight fit for closing its upper end 133. Band 145 formed around the receptacle 123 limits the position to which the cap 137 may be located in its closed position. With the sponges 129A–129H and toothbrushes located in the cavities of the receptacle 123 and with its ends 131 and 133 closed with end caps 135 and 137, vapors from the sterilizing fluid absorbed in the sponges 129A–129H will act to sterilize the toothbrushes. When it is desired to use a toothbrush, the the cap 137 is removed and the toothbrush is grasped by its handle and removed.

The old sponges may be removed and fresh sponges carrying a sterilizing fluid may be inserted by removing the caps 135 and 137; inserting fresh sponges into the cavities through the upper end 133 of the receptacle and pushing the new sponges into the cavities by the handle of one of the toothbrushes. When the new sponges reach the old sponges, they will push the old sponges out through the lower end 131. The cavities may be cleaned by removing the sponges and running water through the cavities of the receptacle 123.

Preferably the amount of sterilizing fluid absorbed into the sponges 129A–129H is sufficient to wet or dampen the sponges as described with reference to the embodiment of FIGS. 1–3. Preferably the receptacles 23 and 123 and caps 37 and 137 are formed of transparent plastic material except the lower end caps 35 and 135 may be formed of an opaque plastic material.

I claim:

1. A toothbrush holder and sterilizer comprising;

receptacle means comprising structure forming a plurality of side-by-side receptacles each having a cavity for receiving a toothbrush, each of said receptacles having first and second open opposite ends, first removable cap means comprising a single member adapted to close said first ends of said receptacles, second removable cap means comprises a single member adapted to close said second ends of said receptacles, and a plurality of removable, absorbent, sponge-like means each carrying a sterilizing fluid adapted to be inserted into said cavities of said receptacles adjacent said first cap means, said removable, absorbent, sponge-like means each having a size sufficient to engage the walls of its cavity, said receptacles with said removable, absorbent, sponge-like means located in said cavities and having their opposite ends closed with said first and second cap means, being adapted to enclose a toothbrush within each of said cavities, said cavities of said receptacles being free from obstructions whereby said removable, absorbent, sponge-like means may be pushed within said cavities from said second ends to said first ends when said second cap means is removed and out of said first ends when said first caps means is removed.

2. A toothbrush holder and sterilizer of claim 1, wherein:

the length of each of said cavities of said receptacle means between its absorbent means, when located in said cavity adjacent said first cap means, and said second end of its receptacle means is less than the toothbrush to be received in said cavity, said second cap means has a plurality of cavities with lengths sufficient to receive the portions of the toothbrushes extending beyond said second ends of said receptacles.

* * * * *